US009888740B2

(12) United States Patent
Ko

(10) Patent No.: US 9,888,740 B2
(45) Date of Patent: Feb. 13, 2018

(54) MULTIPLY SHOCKPROOF, HYGROSCOPIC AND BREATHABLE SHOE PAD AND SHOCKPROOF, HYGROSCOPIC AND BREATHABLE SHOE

(71) Applicant: Wai Yip Ko, Hong Kong (CN)

(72) Inventor: Wai Yip Ko, Hong Kong (CN)

(73) Assignee: Sambo (Shenzhen) Technology New Materials co., Ltd., Shenzhen, Guangdong (CN)

( * ) Notice: Subject to any disclaimer, the term of this patent is extended or adjusted under 35 U.S.C. 154(b) by 0 days.

(21) Appl. No.: 15/024,031

(22) PCT Filed: Jun. 23, 2014

(86) PCT No.: PCT/CN2014/080527

§ 371 (c)(1),
(2) Date: Jul. 2, 2016

(87) PCT Pub. No.: WO2015/039472

PCT Pub. Date: Mar. 26, 2015

(65) Prior Publication Data

US 2016/0302516 A1 Oct. 20, 2016

(30) Foreign Application Priority Data

Sep. 23, 2013 (CN) ..... 2013 2 0584465 U

(51) Int. Cl.
*A43B 7/06* (2006.01)
*A43B 13/12* (2006.01)
(Continued)

(52) U.S. Cl.
CPC ..... *A43B 7/149* (2013.01); *A43B 1/0045* (2013.01); *A43B 3/30* (2013.01); *A43B 7/087* (2013.01);
(Continued)

(58) Field of Classification Search
CPC ..... A43B 1/0045; A43B 7/06; A43B 7/087; A43B 7/125; A43B 13/12; A43B 13/122;
(Continued)

(56) References Cited

U.S. PATENT DOCUMENTS 4,099,342 A * 7/1978 Singh ..... A43B 1/0045 36/44
4,167,824 A * 9/1979 Wolpa ..... A43B 13/38 36/44
(Continued)

*Primary Examiner* — Jameson Collier

(57) ABSTRACT

A multi-ply shockproof, hygroscopic and breathable shoe pad includes, from bottom to top in succession: a support bottom layer (1), wherein a lower end face of the support bottom layer (1) is provided with a plurality of protruding portions (5), an upper end face of the support bottom layer (1) is provided with air holes (6), and the protruding portions (5) and the air holes (6) are alternately arranged; an elastic interlayer (2), wherein the elastic interlayer (2) is provided with air holes (6), and is coated with an antibacterial deodorization layer; a hygroscopic interlayer (3), wherein the hygroscopic interlayer (3) is provided with air holes (6), and is coated with an antibacterial deodorization layer; and a breathable waterproof layer (4) coated with an antibacterial deodorization layer; and the support bottom layer (1), the elastic interlayer (2), the hygroscopic interlayer (3), and the breathable waterproof layer (4) are successively bonded.

1 Claim, 1 Drawing Sheet

(51) Int. Cl.

| | |
|---|---|
| ***A43B 13/14*** | (2006.01) |
| ***A43B 13/18*** | (2006.01) |
| ***A43B 13/38*** | (2006.01) |
| ***A43B 7/14*** | (2006.01) |
| ***A43B 17/08*** | (2006.01) |
| ***A43B 17/00*** | (2006.01) |
| ***A43B 17/10*** | (2006.01) |
| ***A43B 1/00*** | (2006.01) |
| ***A43B 3/30*** | (2006.01) |
| ***A43B 7/08*** | (2006.01) |
| ***A43B 7/32*** | (2006.01) |

(52) U.S. Cl.
CPC ..... *A43B 7/32* (2013.01); *A43B 13/12* (2013.01); *A43B 17/006* (2013.01); *A43B 17/08* (2013.01); *A43B 17/102* (2013.01)

(58) Field of Classification Search
CPC ... A43B 13/125; A43B 13/127; A43B 13/386; A43B 17/003; A43B 17/006; A43B 17/08; A43B 17/14; A43B 17/102; A43B 17/107; B29D 35/122; B29D 35/142
See application file for complete search history.

(56) References Cited

U.S. PATENT DOCUMENTS

| | | | | | |
|---|---|---|---|---|---|
| 5,619,809 | A * | 4/1997 | Sessa | A43B 7/06 | 36/28 |
| 5,891,545 | A * | 4/1999 | Delude | A43B 17/006 | 36/154 |
| 5,983,524 | A * | 11/1999 | Polegato | A43B 7/08 | 36/3 R |
| 6,389,711 | B1 * | 5/2002 | Polegato | A43B 7/08 | 36/3 B |
| 2004/0020075 | A1 * | 2/2004 | Garneau | A43B 7/087 | 36/3 B |
| 2005/0126036 | A1 * | 6/2005 | Wu | A43B 7/08 | 36/3 B |
| 2005/0252035 | A1 * | 11/2005 | Moretti | A43B 7/125 | 36/3 B |
| 2006/0162183 | A1 * | 7/2006 | Polegato Moretti | A43B 13/16 | 36/3 B |
| 2008/0127519 | A1 * | 6/2008 | Byrne | A43B 7/06 | 36/102 |
| 2010/0285081 | A1 * | 11/2010 | Chen | D01D 5/0038 | 424/405 |
| 2012/0266494 | A1 * | 10/2012 | Ko | A43B 7/087 | 36/84 |

* cited by examiner

MULTIPLY SHOCKPROOF, HYGROSCOPIC AND BREATHABLE SHOE PAD AND SHOCKPROOF, HYGROSCOPIC AND BREATHABLE SHOE

CROSS REFERENCE OF RELATED APPLICATION

This is a U.S. National Stage under 35 U.S.C 371 of the International Application PCT/CN2014/080527, filed Jun. 23, 2014, which claims priority under 35 U.S.C. 119(a-d) to CN 201320584465.7, filed Sep. 23, 2013.

BACKGROUND OF THE PRESENT INVENTION

Field of Invention

The present invention relates to a technical field of shoe accessories, and more particularly to a multi-ply shockproof, hygroscopic and breathable shoe pad and a shockproof, hygroscopic and breathable shoe.

Description of Related Arts

Conventional shoe pads or shoes are unable to effectively maintain the dryness, and also unable to exchange air and moisture within the shoes. In spite that there are some improvements on existing shoe pads or shoes, such as magnetizing and medicating, due to no great improvement on the structures of the shoe pads or shoes, the functions which should be possessed, such as sweat absorption, moisture proofing, deodorization and shocking proofing are still unable to simultaneously achieved.

SUMMARY OF THE PRESENT INVENTION

An object of the present invention is to overcome shortcomings of shoe pads and shoes with single function in the prior arts, for providing a multi-ply shockproof, hygroscopic and breathable shoe pad and a shockproof, hygroscopic and breathable shoe.

In order to resolve problems in the prior arts, a technical solution adopted by the present is as follows.

The present invention firstly provides a multi-ply shockproof, hygroscopic and breathable shoe pad, which has improvements on that: the shoe pad from bottom to top in succession comprises:

a support bottom layer, wherein a plurality of protruding portions are located at a lower end face of the support bottom layer, a plurality of air holes are provided at an upper end face of the support bottom layer, and the protruding portions and the air holes are alternately arranged with each other;

an elastic interlayer, wherein a plurality of air holes are provided within the elastic interlayer and an antibacterial deodorant layer is coated on the elastic interlayer;

a hygroscopic interlayer, wherein a plurality of air holes are provided within the hygroscopic interlayer and an antibacterial deodorant layer is coated on the hygroscopic interlayer; and a breathable waterproof layer, wherein an antibacterial deodorant layer is coated on the breathable waterproof layer;

wherein the support bottom layer, the elastic interlayer, the hygroscopic interlayer and the breathable waterproof layer are successively bonded with each other.

The above mentioned technical solution is further explained as follows.

Furthermore, the antibacterial deodorant layer contains nanoscale chitosan.

Furthermore, the support bottom layer is made of polyurethane, silica gel or rubber.

Furthermore, the elastic interlayer is made of elastic sponge or emulsion materials Furthermore, the hygroscopic interlayer is made of cotton cloth, sponge or emulsion materials.

Furthermore, the breathable waterproof layer is made of one or more materials selected from textile fabrics, natural leather, non-woven fabrics and synthetic leather.

Furthermore, the protruding portions, which are evenly distributed, are located at the lower end face of the support bottom layer.

The present invention also provides a shockproof, hygroscopic and breathable shoe, wherein the shoe pad, which is any one of the foregoing shoe pads, is provided within the shockproof, hygroscopic and breathable shoe.

Beneficial effects of the present invention are as below.

(1) The multi-ply shockproof, hygroscopic and breathable shoe pad, provided by the present invention, comprises a support bottom layer which is provided with a plurality of elastic protruding portions and air holes; an elastic interlayer which is provided with the air holes and is coated with an antibacterial deodorant layer; a hygroscopic interlayer; and a breathable waterproof layer which is coated with an antibacterial deodorant layer, wherein the support bottom layer, the elastic interlayer, the hygroscopic interlayer and the breathable waterproof layer are successively bonded with each other, so as to form an integrated four-layer-structure shoe pad and simultaneously achieve relatively comprehensive functions, such as sweat absorption, moisture proofing, deodorization and shock proofing, which has high degree of comfort and strong practicability.

(2) The breathable waterproof layer is made of one or more materials selected from textile fabrics, natural leather, non-woven fabrics and synthetic leather, and applies a technology which imitates lotus leaf surfaces to achieve anti-siphon and no moisture absorption, and moreover, an antibacterial deodorant layer is coated on the breathable waterproof layer for forming an outermost layer of the multi-ply shockproof, hygroscopic and breathable shoe pad. As a result, sweats and moistures of soles and socks are rapidly guided to the elastic interlayer and the hygroscopic interlayer, so as to avoid the dampness of the surface of the shoe pad, for improving the foot dryness of a wearer, thereby resolving the foot wetness from people who have to wear sealing shoes over a long period of time.

(3) The antibacterial deodorant layer contains nanoscale chitosan, which applies the most advanced nano-composite technology nowadays to allow the elastic interlayer, the hygroscopic interlayer and the breathable waterproof layer to achieve a lasting antibacterial effect. It is proved that 100% colibacillus is still able to effectively eliminated after washing the antibacterial deodorant layer for 20 times, thus restraining the odor from bacteria.

(4) The multi-ply shockproof, hygroscopic and breathable shoe pad has a wide range of applications, is able to be applied to various types of shoes, and also enables these shoes to have a shockproof, hygroscopic and breathable property.

Figure 1:
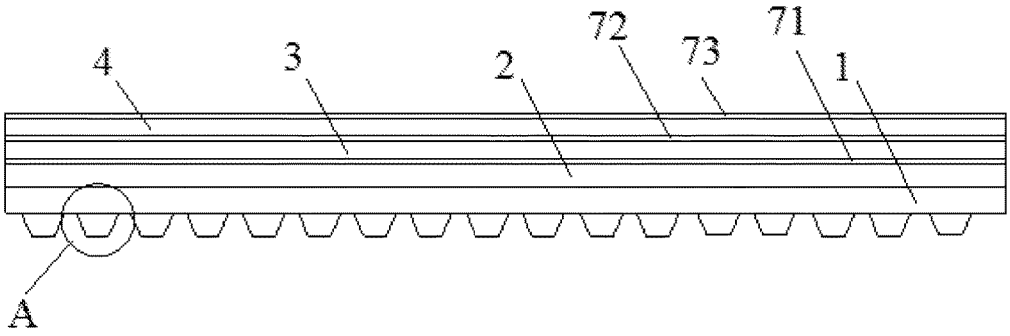
FIG. 1 is a schematic view of a multi-ply shockproof, hygroscopic and breathable shoe pad according to a preferred embodiment of the present invention.

Referring to the drawings, the objectives, functional characteristics and advantages of the present invention are further explained in combination with embodiments.

DETAILED DESCRIPTION OF THE PREFERRED EMBODIMENT

The technical solution of the present invention is explained in detail with the accompanying drawings and embodiments, so that the essence of the present invention is more clearly and intuitively understood.

Figure 2:
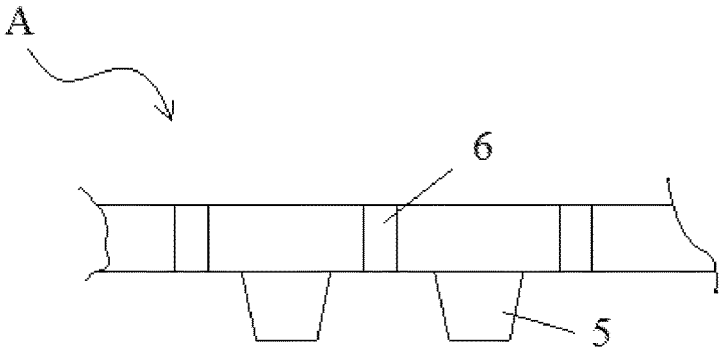
FIG. 2 is an enlarged view of Section A in FIG. 1.
Figure 3:
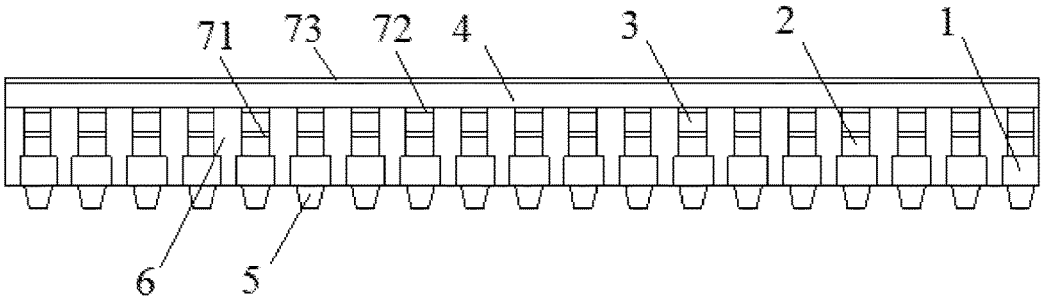
FIG. 3 is a sectional view of FIG. 1.

Referring to FIGS. 1, 2 and 3 of the drawings, a multi-ply shockproof, hygroscopic and breathable shoe pad according to a preferred embodiment of the present invention from bottom to top in succession comprises a support bottom layer 1, an elastic interlayer 2, a hygroscopic interlayer 3 and a breathable waterproof layer 4, wherein the support bottom layer 1, the elastic interlayer 2, the hygroscopic interlayer 3 and the breathable waterproof layer 4 are successively bonded with each other.

Specifically, the support bottom layer 1 is made of polyurethane, silica gel or rubber materials; a plurality of elastic protruding portions 5, which are evenly distributed, are located at a lower end face of the support bottom layer 1, a plurality of air holes 6 are provided at an upper end face of the support bottom layer 1, and the elastic protruding portions 5 and the air holes 6 are alternately arranged with each other; the elastic interlayer 2 is made of elastic sponge or emulsion materials, the evenly distributed air holes 6 are provided within the elastic interlayer 2, and a first layer of antibacterial deodorant material 71 is coated on the elastic interlayer 2; the hygroscopic interlayer 3 is made of cotton cloth, sponge or emulsion materials, a second layer of antibacterial deodorant material 72 is coated on the hygroscopic interlayer 3, the evenly distributed air holes 6 are also provided within the hygroscopic interlayer 3, and the air holes within the support bottom layer 1, the air holes 6 within the elastic interlayer 2 and the air holes 6 within the hygroscopic interlayer 3 have same arrangement positions, so as to form the air holes 6 penetrating through the support bottom layer 1, the elastic interlayer 2 and the hygroscopic interlayer 3; the breathable waterproof layer 4 is made of one or more materials selected from textile fabrics, natural leather, non-woven fabrics and synthetic leather, and applies a technology which imitates lotus leaf surfaces to achieve anti-siphon and no moisture absorption, and moreover, a third layer of antibacterial deodorant material 73 is coated on the breathable waterproof layer 4 for forming an outermost layer of the multi-ply shockproof, hygroscopic and breathable shoe pad. As a result, sweats and moistures of soles and socks are rapidly guided to the elastic interlayer 2 and the hygroscopic interlayer 3, so as to avoid the dampness of the surface of the shoe pad, for improving the foot dryness of a wearer, thereby resolving the foot wetness from people who have to wear sealing shoes over a long period of time.

It should be noted that, the antibacterial deodorant material contains nanoscale chitosan, which applies the most advanced nano-composite technology nowadays to allow the elastic interlayer 2, the hygroscopic interlayer 3 and the breathable waterproof layer 4 to achieve a lasting antibacterial effect; it is proved that 100% colibacillus is still able to effectively eliminated after washing the first layer of antibacterial deodorant material 71, the second layer of antibacterial deodorant material 72 and the third layer of antibacterial deodorant material 73 for 20 times, thus restraining the odor from bacteria.

The multi-ply shockproof, hygroscopic and breathable shoe pad of the present invention is designed to achieve shockproof, hygroscopic and breathable functions based on various physical characteristics of various materials, allow the heats and sweats of feet to penetrate from the upper breathable waterproof layer 4 for being absorbed by both the elastic interlayer 2 and the hygroscopic interlayer 3 with strong hygroscopicity and breathability, such that no bacteria are bred and no odor is produced; and simultaneously, the support bottom layer 1 with the evenly distributed elastic protruding portions 5 is adopted to evenly disperse physical pressures and is able to adapted for various foot shapes. Therefore, the above mentioned shoe pad keeps the uppermost layer which clings to the instep dry over a long period of time, and greatly improves the comfortableness cooperating with the dispersing shockproof performance of the lowermost layer.

The multi-ply shockproof, hygroscopic and breathable shoe pad has a wide range of applications, is adapted for various types of shoes, such as men and women leather shoes, and child's shoes, so that the pressures and heats from feet while people wearing shoes walk are reduced, thus it is very suitable for people who need long-term walking or standing to use.

The embodiment of the present invention described above is exemplary only and not intended to be limiting. The equivalent structures or transformations based on the specification and drawings of the present invention, which are directly or indirectly applied to other related technical fields, are similarly encompassed within the scope protected by the present invention.

What is claimed is:

1. A multi-ply shockproof, hygroscopic and breathable shoe pad, comprising:

a support bottom layer having a plurality of air holes therein, wherein a plurality of protruding portions are located at a lower end face of the support bottom layer, and the protruding portions and the air holes are alternately arranged with each other;

an elastic interlayer having a plurality of air holes therein, wherein a first layer of antibacterial deodorant material is coated on the elastic interlayer;

a hygroscopic interlayer having a plurality of air holes therein, wherein a second layer of antibacterial deodorant material is coated on the hygroscopic interlayer; and a breathable waterproof layer, wherein a third layer of antibacterial deodorant material is coated on the breathable waterproof layer, wherein:

the elastic interlayer is located on the support bottom layer, the hygroscopic interlayer is located on the elastic interlayer and the breathable waterproof layer is located on the hygroscopic interlayer;

the air holes of the hygroscopic interlayer, the air holes of the elastic interlayer and the air holes of the support bottom layer are in fluid communication with one another in a manner that allows air to pass through each of the air holes of the multiple layers in a single path;

the antibacterial deodorant material contains nanoscale chitosan;

the support bottom layer is made of polyurethane, silica gel or rubber;

the elastic interlayer is made of elastic sponge or emulsion materials;

the hygroscopic interlayer is made of cotton cloth, sponge or emulsion materials;

the breathable waterproof layer is made of one or more materials selected from textile fabrics, natural leather, non-woven fabrics and synthetic leather;

the protruding portions are evenly distributed at the lower end face of the support bottom layer.

* * * * *